US009610959B2

(12) United States Patent
Pless et al.

(10) Patent No.: US 9,610,959 B2
(45) Date of Patent: Apr. 4, 2017

(54) MONITORING SYSTEM, WAYSIDE LED SIGNALING DEVICE, AND METHOD FOR MONITORING A WAYSIDE LED SIGNALING DEVICE

(71) Applicant: SIEMENS INDUSTRY, INC., Alpharetta, GA (US)

(72) Inventors: Travis Pless, Waddy, KY (US); Barton DeJarnatt, Louisville, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 10 days.

(21) Appl. No.: 14/725,295

(22) Filed: May 29, 2015

(65) Prior Publication Data

US 2016/0347336 A1 Dec. 1, 2016

(51) Int. Cl.

| | |
|---|---|
| ***G01J 1/42*** | (2006.01) |
| ***B61L 7/10*** | (2006.01) |
| ***B61L 5/18*** | (2006.01) |

(52) U.S. Cl.

CPC *B61L 7/10* (2013.01); *B61L 5/18* (2013.01); *B61L 5/1881* (2013.01); *B61L 2207/02* (2013.01)

(58) Field of Classification Search

CPC .... G01J 1/42; G01J 1/04; G01J 1/4257; G01J 1/44; G01J 1/0488

USPC ..... 356/218

See application file for complete search history.

(56) References Cited

U.S. PATENT DOCUMENTS

| | | | | |
|---|---|---|---|---|
| 5,358,202 | A * | 10/1994 | Tse | B61L 3/246 246/167 R |
| 6,463,337 | B1 | 10/2002 | Walker | |
| 8,515,697 | B2 | 8/2013 | Alexander et al. | |
| 2004/0141293 | A1* | 7/2004 | Chun | F21V 7/04 361/715 |
| 2005/0062481 | A1* | 3/2005 | Vaughn | B61L 5/1881 324/500 |
| 2005/0253689 | A1* | 11/2005 | Mollet | B61L 27/0005 340/286.01 |
| 2011/0115408 | A1 | 5/2011 | Fannin | |
| 2011/0276285 | A1 | 11/2011 | Alexander et al. | |

(Continued)

FOREIGN PATENT DOCUMENTS

| | | |
|---|---|---|
| EP | 0979597 B1 | 7/2002 |
| WO | 02074017 A1 | 9/2002 |

OTHER PUBLICATIONS

PCT International Search Report and Written Opinion mailed Sep. 16, 2016 corresponding to PCT Application No. PCT/US2016/032972 filed May 18, 2016 (14 pages).

*Primary Examiner* — Tarifur Chowdhury
*Assistant Examiner* — Md M Rahman

(57) ABSTRACT

A monitoring system for a wayside signaling device includes a light emitting diode (LED) circuit with an LED array, a LED driver unit for driving the LED array, and a mechanism for connecting and disconnecting the LED circuit, and an optical light sensing circuit with a light-controlled variable resistor operably coupled to a resistor driver unit including relay functionality. The LED circuit and the sensing circuit are arranged such that the light-controlled variable resistor monitors an output of the LED array, and that the relay functionality triggers the mechanism to connect or disconnect the LED circuit based on the output of the LED array.

15 Claims, 3 Drawing Sheets

(56) References Cited

U.S. PATENT DOCUMENTS

| | | | | |
|---|---|---|---|---|
| 2013/0073087 | A1* | 3/2013 | Irmler | B25J 11/0015 700/259 |
| 2015/0282270 | A1* | 10/2015 | Loveridge | H05B 33/0845 315/224 |

* cited by examiner

MONITORING SYSTEM, WAYSIDE LED SIGNALING DEVICE, AND METHOD FOR MONITORING A WAYSIDE LED SIGNALING DEVICE

BACKGROUND

1. Field

Aspects of the present invention generally relate to a monitoring system, a wayside light emitting diode (LED) signaling device, and a method for monitoring a wayside LED signaling device.

2. Description of the Related Art

The railroad industry, including but not limited to the freight railroad industry, employs wayside lights to inform train operators of various types of operational parameters. For example, colored wayside signal lights are often used to inform a train operator as to whether and how a train may enter a block of track associated with the wayside signal light. The status/color of wayside signal lamps is sometimes referred to in the art as the signal aspect. One simple example is a three color system known in the industry as Automatic Block Signaling (ABS), in which a red signal indicates that the block associated with the signal is occupied, a yellow signal indicates that the block associated with the signal is not occupied but the next block is occupied, and green indicates that both the block associated with the signal and the next block are unoccupied. It should be understood, however, that there are many different kinds of signaling systems. Other uses of signal lights to provide wayside status information include lights that indicate switch position, hazard detector status (e.g., broken rail detector, avalanche detector, bridge misalignment, grade crossing warning, etc.), search light mechanism position, among others.

Existing wayside signals including incandescent bulbs are lit from either vital relay-based systems or vital processor-based systems that are available from a wide variety of manufacturers. The two basic types of systems have different interface characteristics, and interface characteristics vary substantially within the various processor-based systems. The systems permit hot and cold filament checks in order to detect lamp malfunction. Hot-filament checking implies verifying that sufficient visible light is being emitted when the appropriate input is provided to the signal head. Cold filament checking is similar, but is a check done when the aspect is not illuminated. This provides advance knowledge of a lamp failure so that the preceding aspects can be downgraded in advance, thus preventing a sudden unexpected downgrade.

Wayside signaling is moving away from incandescent bulbs to LED (light emitting diode) lighting. The benefits of wayside LED signals are improved visibility, higher reliability and lower power consumption. However, current wayside LED signaling devices are incapable of providing real time light out indication, i.e. lamp malfunction, in particular when utilizing a LED retrofit design for existing signal heads. For example, LED driver circuitry does not permit the current methods of hot and cold filament checks of incandescent bulbs. An option for retrofitting existing signal heads with LED lighting is to use microprocessor-based systems to monitor the status of the wayside signals. But such an upgrade requires extra installation, maintenance, and operational costs. Also, there are solutions that utilize a lamp unit input sensing resistor to verify operation. But this solution introduces an undesirable heat byproduct to the signal housing. Thus, the railroad industry and railroad owners wishing to upgrade their in-service wayside signaling heads by retrofit must choose LED lighting and losing light out detection or incandescent signaling bulbs with light out detection.

SUMMARY

Briefly described, aspects of the present invention relate to a monitoring system, a wayside light emitting diode (LED) signaling device, and a method for monitoring a wayside LED signaling device. In particular, the LED signaling device is configured as railroading wayside signaling device for installing along railroad tracks.

One of ordinary skill in the art appreciates that such a LED signaling device can be configured to be installed in different environments where signaling devices may be used, for example in road traffic.

A first aspect of the present invention provides a monitoring system for a wayside signaling device comprising a light emitting diode (LED) circuit comprising at least one LED, a LED driver unit for driving the at least one LED, and a mechanism for connecting and disconnecting the LED circuit; and an optical light sensing circuit comprising at least one light-controlled variable resistor operably coupled to a resistor driver unit comprising relay functionality, wherein the LED circuit and the sensing circuit are arranged such that the at least one light-controlled variable resistor monitors an output of the at least one LED, and that the relay functionality triggers the mechanism to connect or disconnect the LED circuit based on the output of the at least one LED.

A second aspect of the present invention provides a wayside light emitting diode (LED) signaling device comprising a light emitting diode (LED) circuit comprising a LED array with a plurality of LEDs, a LED driver unit for driving the LED array, and a mechanism for connecting and disconnecting the LED circuit, and an optical light sensing circuit comprising at least one light-controlled variable resistor operably coupled to a resistor driver unit comprising a relay module. The at least one light-controlled variable resistor is installed in proximity to the LED array to monitor an output of the LED array, and wherein the relay module is in communication with the mechanism to connect or disconnect the LED circuit based on the output of the LED array.

A third aspect of the present invention provides a method for monitoring a light emitting diode (LED) circuit in a wayside light emitting diode (LED) signaling device. The method comprises installing a light emitting diode (LED) circuit comprising a LED array with a plurality of LEDs, a LED driver unit for driving the LED array, and a mechanism for connecting and disconnecting the LED circuit in a wayside LED signaling device. The method further comprises installing an optical light sensing circuit comprising at least one light-controlled variable resistor operably coupled to a resistor driver unit comprising a relay module in the wayside LED signaling device. The at least one light-controlled variable resistor is installed in proximity to the LED array to monitor an output of the LED array, and wherein the relay module is in communication with the mechanism to connect or disconnect the LED circuit based on the output of the LED array.

DETAILED DESCRIPTION

To facilitate an understanding of embodiments, principles, and features of the present invention, they are explained hereinafter with reference to implementation in illustrative embodiments. In particular, they are described in the context of being a monitoring system, a wayside LED signaling device and a method for monitoring a wayside LED signaling device. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Wayside railroad signal display aspects provide the only means of authority for train movements in many control systems. In other control systems, the displayed aspect is important to ensure safe train separation. In all implementations, failure to display the desired aspect has a potential safety implication. To achieve safe railroad operations, the system should have a reliable method for determining that a signal aspect intended for display by the control system is, in fact, being displayed. Light out detection is used for downgrading approach lights in the event of a signaling lamp failure, and currently can only be implemented using incandescent bulb signaling techniques.

Figure 1:
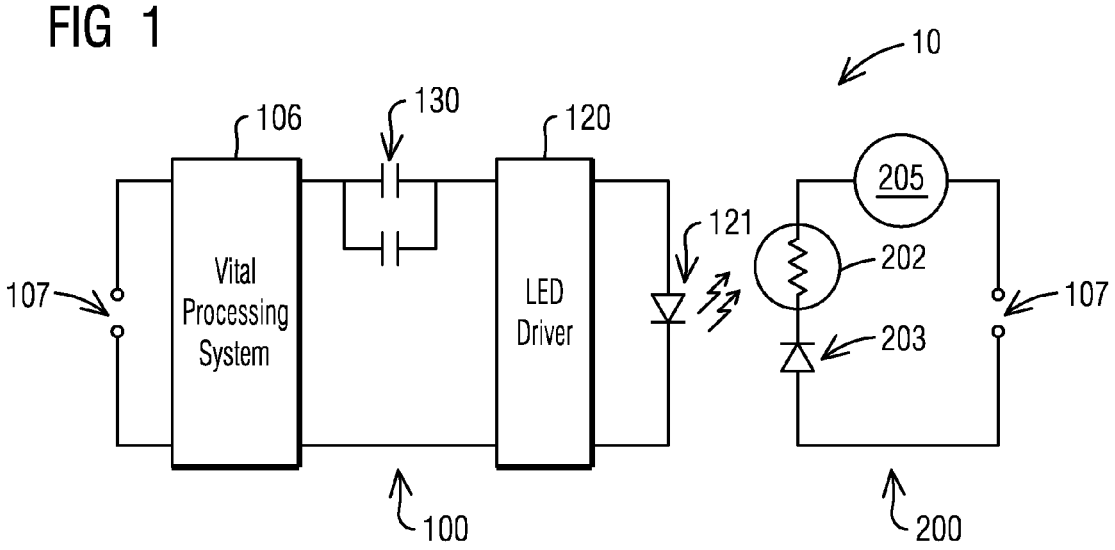
FIG. 1 illustrates a basic schematic of a monitoring system in accordance with an exemplary embodiment of the present invention.

FIG. 1 illustrates a basic schematic of a monitoring system 10 in accordance with an exemplary embodiment of the present invention. The monitoring system 10 comprises a light emitting diode (LED) circuit 100 and an optical light sensing circuit 200 arranged in parallel. The LED circuit 100 generally comprises an LED driver 120 and at least one LED 121. Typically, a plurality of LEDs is provided. The LED circuit 100 is coupled to at least one vital processing system 106 and a power source 107, for example a voltage source. The optical light sensing circuit 200 generally comprises at least one light-controlled variable resistor 202, such as for example a photo-resistor or light-dependent resistor or photocell, arranged in proximity to the at least one LED 121 so that the resistor 202 can detect the emitted light of the LED 121. The optical light sensing circuit 200 further comprises a sacrificial diode 203 to drive the resistor 202 and a relay functionality 205 configured to trigger a mechanism 130 of the LED circuit 100 to connect and/or disconnect the LED circuit 100 in order to mimic or simulate a filament burn out when the at least one LED 121 is not operating properly. The optical light sensing circuit 200 is also coupled to a power source, for example a voltage source. The optical light sensing circuit 200 can be connected to the power source 107, as illustrated in FIG. 1, or may be connected to a different power source, for example a battery. The provided monitoring system 10 provides visually verifying that an output of the at least one LED 121 is properly driven and operating.

The mechanism 130 of the LED circuit 100 to connect and/or disconnect the LED circuit 100 in order to mimic or simulate a filament burn out when the at least one LED 121 is not operating properly can be embodied as a momentary switch. A momentary switch is a type of switch that is only engaged while it is being operated (as opposed to a typical "on/off" switch, which latches in its set position).

Figure 2:
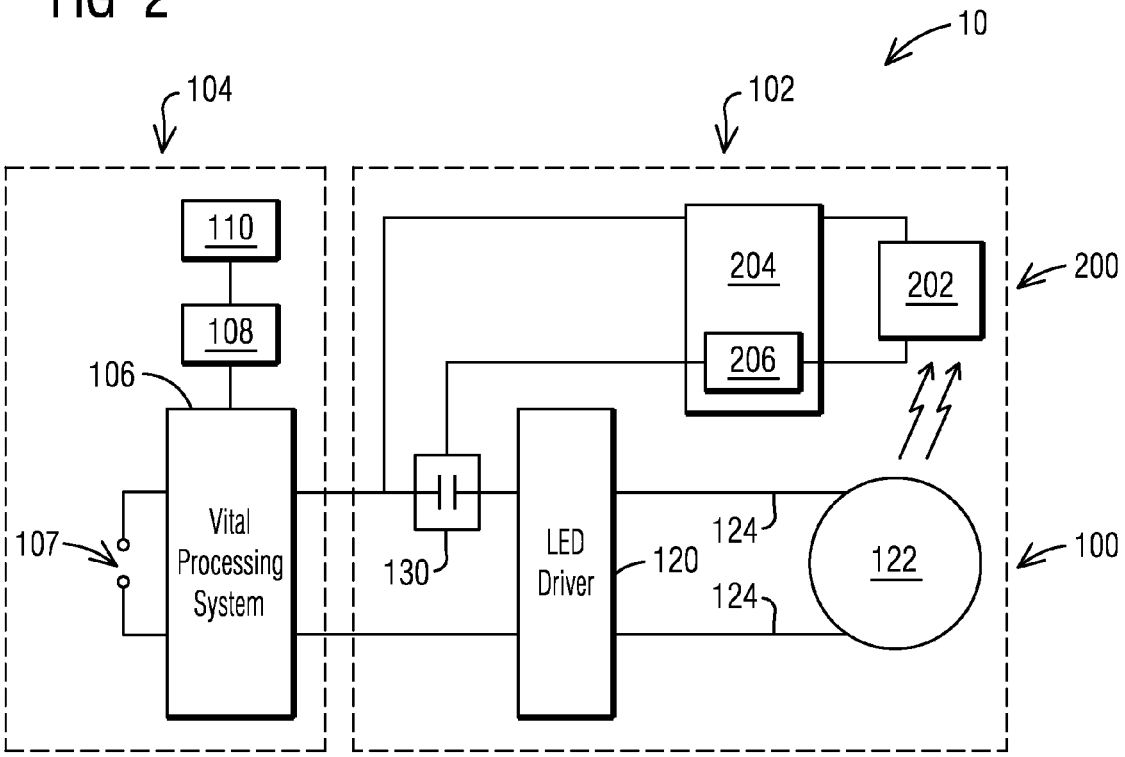
FIG. 2 illustrates a schematic of a monitoring system of FIG. 1 comprising a light emitting diode (LED) circuit and an optical light sensing circuit in accordance with an exemplary embodiment of the present invention.

FIG. 2 illustrates a schematic of a monitoring system 10 of FIG. 1 comprising a light emitting diode (LED) circuit 100 and an optical light sensing circuit 200 in accordance with an exemplary embodiment of the present invention. The LED circuit 100 can be operated using a processor-based system or a relay-based system. A wayside interface unit 104 is configured to monitor the state of a LED signaling device 102, herein also referred to as signal head 102, declare an aspect for signal head 102, and wirelessly transmit the declared aspect so that it can be received by an oncoming train, i.e., by an on-board computer of the oncoming train. Wayside interface unit 104 includes at least one vital processing system 106 comprising a suitable processing device such as, without limitation, a field programmable gate array (FPGA), a microprocessor, a microcontroller, or a programmable logic controller (PLC). The vital processing system 106 is operatively coupled to a communications processing unit 108, such as an FPGA, a microprocessor, a microcontroller, or a PLC, which in turn is coupled to a wireless communications unit 110, such as for example an RF radio element.

The signal head 102, installed for example along railroad tracks, comprises the LED circuit 100. The LED circuit 100 comprises a LED driver unit 120 which drives a LED array 122 comprising a plurality of individual LEDs. The vital processing system 106 controls the LED driver 120 which drives the LED array 122 in at least on, flashing on/off, and/or off states. The LED circuit 100 further comprises a type of switch or relay mechanism 130, in particular a momentary switch mechanism, for example a relay coil or solid-state electronic components such as transistors, which can open and close, i.e. disconnect and connect, the LED circuit 100.

When the LED array 122 is on or flashing on, a current is induced in wires 124. But even if the LED array 122 is drawing current, it can be difficult to indicate that individual LED's of the array 122 are emitting light. For example, certain LED technologies have embedded protection diodes as part of the LED array 122 itself that have the potential of shorting and allowing current to flow while bypassing the light generating portion of the LED array 122. Another aspect is that LED signals generally have electronic components in the signal head to provide a regulated, constant supply current to the individual LED's. Failures in these electronic components also have the effect of allowing the signal head to draw current even though no light is being generated.

The embodiment as illustrated in FIG. 2 comprises a light out detection circuit configured as an optical light sensing circuit 200. The optical light sensing circuit 200 is configured to detect that sufficient light is being generated and emitted from the plurality of LEDs of the LED array 122, and to verify that the LED array 122 is operating properly.

The optical light sensing circuit 200 comprises at least one light-controlled variable resistor 202, such as for example a photo-resistor or light-dependent resistor or photocell, operably connected to a resistor driver unit 204. If needed, the optical light sensing circuit can comprise a plurality of light-controlled variable resistors 202. For example, the resistor driver unit 204 can comprise a sacrificial diode connected in series to the light-controlled variable resistor 202 in order to drive the resistor 202. Furthermore, the optical light sensing circuit 200 comprises a relay functionality configured to trigger the relay or switch mechanism 130 of the LED circuit to connect and disconnect the LED circuit 100 in order to mimic or simulate a filament burn out when the LED array 122 is not operating properly. The resistor driver unit 204 can be directly connected to the power source 107 or can be indirectly connected to the power source 107, for example via the vital processing system 106. The optical light sensing circuit 200 can be part of the signal head 102, as illustrated in FIG. 2. Both LED circuit 100 and optical light sensing circuit 200 are coupled to a power source for operation, which can be the same power source, for example power source 107, or different power sources.

The resistor driver unit 204 can comprise the relay functionality of the optical light sensing circuit 200, for example in form of a 12V DC power relay module 206. The at least one light-controlled variable resistor 202 is operably coupled to the driver unit 204, and provides input to the driver unit 204. The switch mechanism 130 of the LED circuit 100 is operably coupled to the driver unit 204 comprising the relay module 206, in particular to at least one output of the driver unit 204. The resistor driver unit 204 can be embodied as one electronic component comprising the relay module 206 and the sacrificial diode to drive the light-controlled variable resistor 202. One of ordinary skill in the art will appreciate that the sensor driver unit 204 can be embodied as separate electronic components and/or can comprise additional electronic components not described herein.

When operating the signaling device 102, at least the following basic hazards must be mitigated:

- Wayside signal must not flash, at any rate or for any duration, at any input voltage from zero to maximum rated input voltage unless responding to a flashing input voltage.
- Wayside signal must not flash, at any rate or for any duration, in response to processor-based output check signals or processor-based cold filament check pulses.
- Where light out detection is used, wayside signal must not indicate that light is being generated when less than 50% of the rated light output is being generated.

The LED driver unit 120 is configured such that the LED array 122 comprising the plurality of individual LEDs is driven in accordance with the above referenced standards.

The resistance of a light-controlled variable resistor decreases with increasing incident light intensity. When the light intensity decreases, the resistance increases. The sensitivity of the at least one light-controlled variable resistor 202 can be adjusted using for example a potentiometer arranged in the resistor driver unit 204. When the LED array 122 generates and emits at least 50% of the rated light output of the plurality of LEDs, the resistance of the light-controlled variable resistor 202 decreases and current increases.

As described before, the light-controlled variable resistor 202 is coupled to the resistor driver unit 204 as well as the relay module 206, and the relay module 206 is in turn in communication with the switch mechanism 130 of the LED circuit 100. Thus, when the resistor 202 detects at least 50% of the rated light output of the LED array 122, the current flowing in the light sensing circuit 200 is high enough that the relay module 206 triggers the mechanism 130 of the circuit 100 to close the circuit 100. When less of the rated light output of the arranged LEDs in the array 122 is generated and less than 50% is detected by the resistor 202, the current decreases and the relay module 206 is triggered such that the mechanism 130 opens and disconnects the LED circuit 100. According to the described embodiment, the threshold value for connecting the LED circuit 100 is at 50% of the rated light output of the LEDs of the LED array 122. When less than 50% is emitted, which means that the output of the optical signal of the LED circuit 100 is not operating according to the above-identified standards (basic hazards), the circuit mimics and/or simulates the operational conditions of known incandescent signal heads and properly downgrades approach signals. One of ordinary skill in the art understands that the threshold value can be adjusted to many other values, for example 40% or 60% of a rated light output of a lamp.

In other embodiments of a monitoring system 10, an optocoupler or optoisolator may be placed between the LED circuit 100 and the optical light sensing circuit 200 to transfer electrical signals between the two isolated circuits 100 and 200 by using light. For example, the optocoupler can comprise a LED and a phototransistor. The optocoupler can be placed such that the optocoupler-LED is part of the LED circuit 100 and the phototransistor is part of the light sensing circuit 200.

Figure 3:
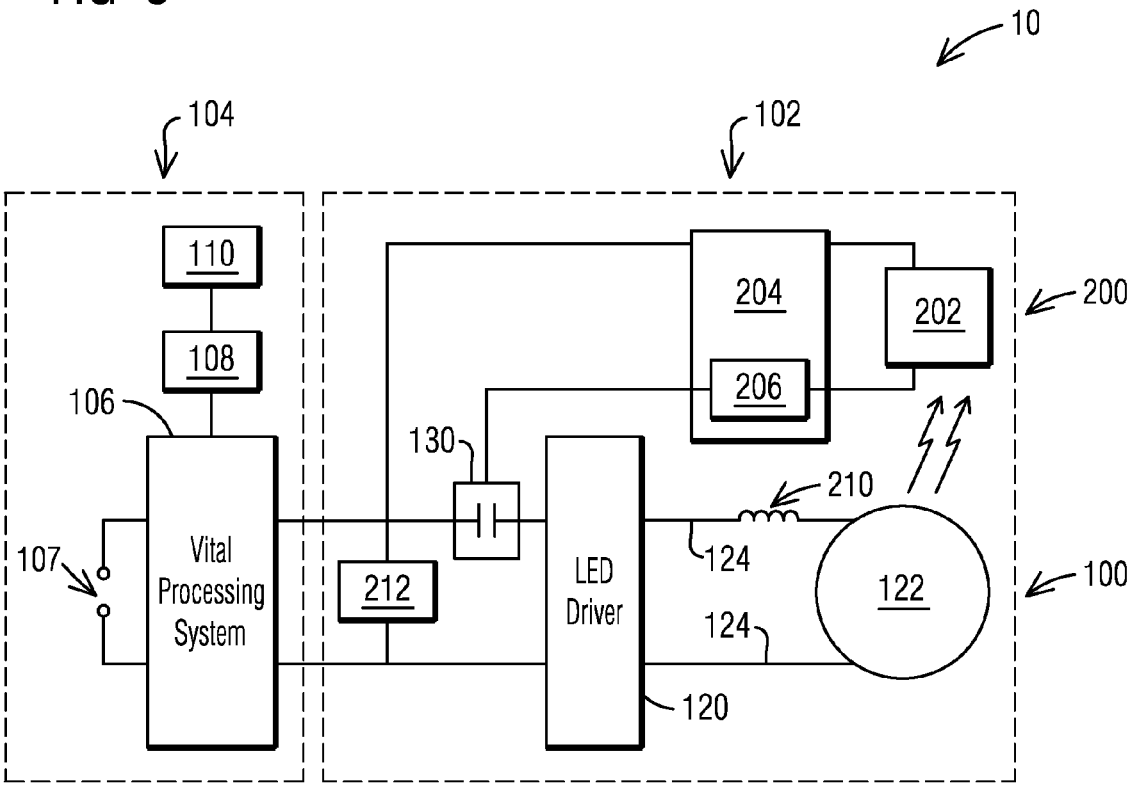
FIG. 3 illustrates a schematic of a monitoring system comprising a light emitting diode (LED) circuit and an optical light sensing circuit in accordance with an exemplary embodiment of the present invention

FIG. 3 illustrates a schematic of a monitoring system 10 comprising a light emitting diode (LED) circuit 100 and an optical light sensing circuit 200 in accordance with an exemplary embodiment of the present invention. The monitoring system 10 as illustrated in FIG. 3 generally corresponds to the monitoring system 10 as illustrated in FIG. 2. In order to be able to perform not only hot filament checks, as described for example with reference to FIG. 2, but also cold filament checks, the monitoring system 10 can comprise additional components. As described before, cold filament checking is done when the aspect is not illuminated, i.e., a cold filament check only checks wiring continuity to the signal head 102. To perform such cold filament checks, the LED circuit 100 can comprise a passive inductor 210 to block any high frequency output of check signals provided by the processing unit 106. The passive inductor is placed in series with the LED array 122 and can for example block flashes caused by check pulses (check signals). Furthermore, a passive bandpass filter 212 is paired, i.e., placed in parallel, with an output of the processing unit 106, which can be for example a programmable logic controller (PLC) output, to check the continuity of the check pulses (check signals) to an input of the processing unit 106. The provided exemplary embodiment for a cold filament check retains the retrofit solution as described before with reference to FIG. 1 and FIG. 2.

Figure 4:
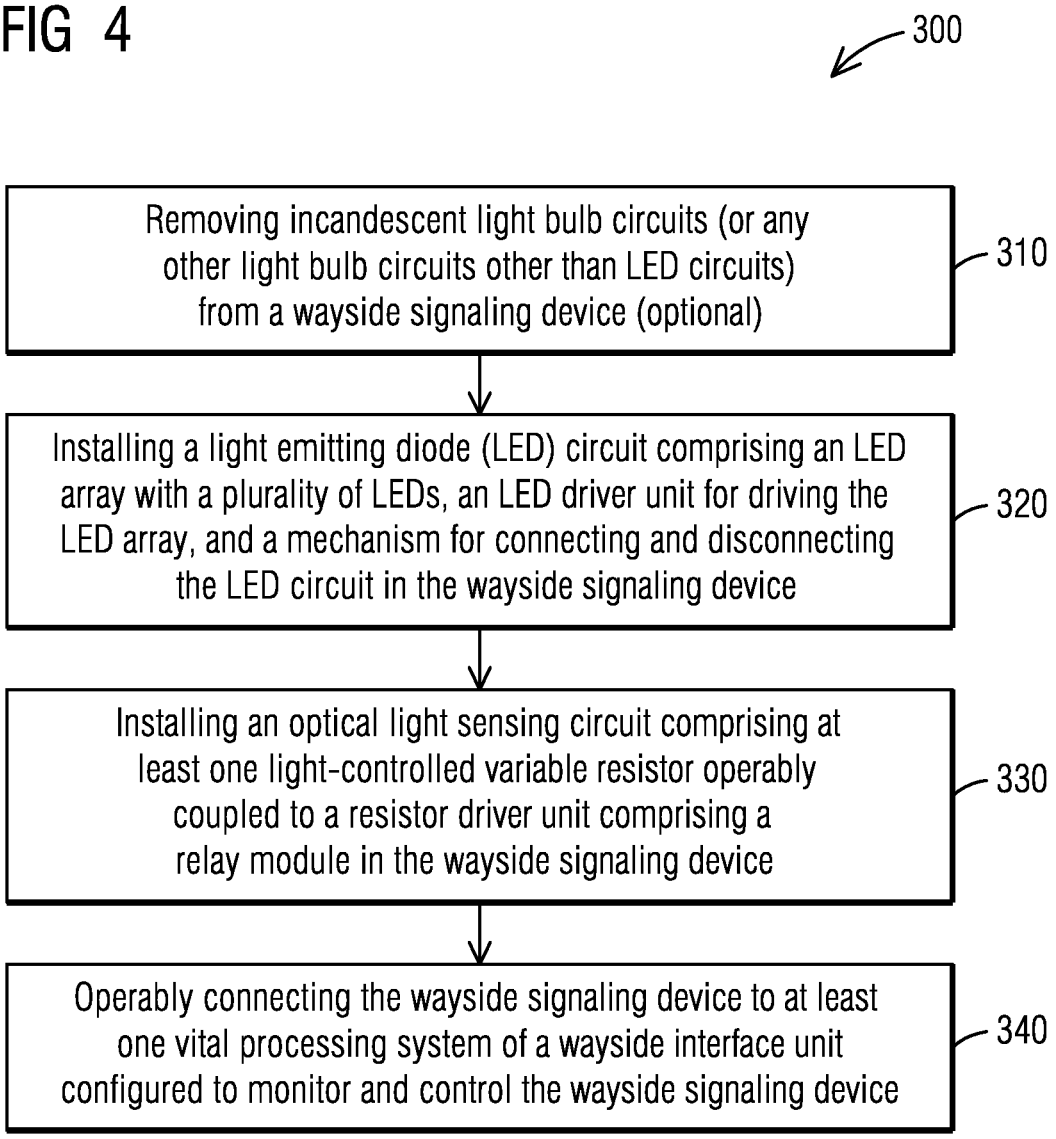
FIG. 4 illustrates a flow chart of a method for monitoring a light emitting diode (LED) circuit in a wayside light emitting diode (LED) signaling device in accordance with an exemplary embodiment of the present invention.

FIG. 4 illustrates a flow chart of a method 300 for monitoring a light emitting diode (LED) circuit 100 in a wayside light emitting diode (LED) signaling device 102 in accordance with an exemplary embodiment of the present invention. Reference is made to the elements and features described in FIGS. 1-3. It should be appreciated that some steps are not required to be performed in any particular order, and that some steps are optional.

In step 320, a (LED) circuit 100 comprising a LED array 122 with a plurality of LEDs, a LED driver unit 120 for driving the LED array 122, and a mechanism 130 for connecting and disconnecting the LED circuit 100 is installed in a wayside LED signaling device 102. In step 330, an optical light sensing circuit 200 comprising at least one light-controlled variable resistor 202 operably coupled to a resistor driver unit 204 comprising a relay module 206 is installed in the wayside LED signaling device 102. The at least one light-controlled variable resistor 202 is installed in proximity to the LED array 122 to monitor an output of the LED array 122, and wherein the relay module 206 is in communication with the mechanism 130 to connect or disconnect the LED circuit 100 based on the output of the LED array 122.

Before installing the LED circuit 100 and the optical light sensing circuit 200, incandescent light bulb circuits (or any other light bulb circuits other than LED circuits), if existing, are removed from the wayside signaling device, see step 310. Step 310 is an optional step.

In step 340, the LED signaling device 102 is being operably connected to at least one vital processing system 106 of a wayside interface unit 104 configured to monitor and control the LED signaling device 102, wherein the LED circuit 100 further comprises a passive inductor 210 arranged in series with the LED array 122, and a passive bandpass filter 212 arranged in parallel with an output of the vital processing system 106.

The present monitoring system provides a replacement (retrofit) wayside LED signal module that can be installed in an existing incandescent signal head itself (which currently includes incandescent bulbs) without modifying either the existing signal head wiring or the control circuitry located in the wayside bungalow or case. Railroad owners can retrofit their existing signaling lamps while retaining the safety provided by current light out detection. All circuitry is contained within the light apparatus and does not require any extra wiring or monitoring systems. Furthermore, the LED signal module can be designed to have only one type (or at least a very small number) of replacement LED signal units to minimize the required spares inventory and to minimize potential safety hazards of installing the wrong replacement unit at any given location.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A monitoring system for a wayside signaling device comprising:

a light emitting diode (LED) circuit comprising at least one LED, a LED driver unit for driving the at least one LED, and a mechanism for connecting and disconnecting the LED circuit;

an optical light sensing circuit comprising at least one light-controlled variable resistor operably coupled to a resistor driver unit comprising relay functionality; and a vital processing system, the LED circuit and the optical light sensing circuit being operably connected to the vital processing system, wherein the LED circuit and the sensing circuit are arranged such that the at least one light-controlled variable resistor monitors an output of the at least one LED, and that the relay functionality triggers the mechanism to connect or disconnect the LED circuit based on the output of the at least one LED, and wherein the LED circuit further comprises a passive inductor arranged in series with the at least one LED, and a passive bandpass filter arranged in parallel with an output of the vital processing system for performing cold filament checks.

2. The monitoring system of claim 1, wherein the mechanism connects the LED circuit when the output of the at least one LED is above a predefined threshold value, and disconnects the LED circuit when the output of the at least one LED is below the predefined threshold value.

3. The monitoring system of claim 2, wherein the mechanism connects the LED circuit when the output of the at least one LED is at least 50% of the rated light output of the at least one LED.

4. The monitoring system of claim 2, wherein the mechanism disconnects the LED circuit when the output of the at least one LED is less than 50% of the rated light output of the at least one LED.

5. The monitoring system of claim 1, wherein the at least one light-controlled variable resistor is selected from the group consisting of a photo-resistor, light-dependent resistor, a photocell, a phototransistor, and a combination thereof.

6. The monitoring system of claim 1, wherein the resistor driver unit comprises a relay module comprising the relay functionality, and wherein the relay module is in communication with the mechanism to connect and disconnect the LED circuit based on a current flowing in the optical light sensing circuit.

7. A wayside light emitting diode (LED) signaling device comprising:

a light emitting diode (LED) circuit comprising a LED array with a plurality of LEDs, a LED driver unit for driving the LED array, and a mechanism for connecting and disconnecting the LED circuit, and an optical light sensing circuit comprising at least one light-controlled variable resistor operably coupled to a resistor driver unit comprising a relay module, wherein the at least one light-controlled variable resistor is installed in proximity to the LED array to monitor an output of the LED array, and wherein the relay module is in communication with the mechanism to connect or disconnect the LED circuit based on the output of the LED array, wherein the LED signaling device is in communication with at least one vital processing system of a wayside interface unit configured to monitor and control the LED signaling device, and wherein the LED circuit further comprises a passive inductor arranged in series with the LED array, and a passive bandpass filter arranged in parallel with an output of the at least one vital processing system for performing cold filament checks.

8. The wayside LED signaling device of claim 7, wherein the vital processing system is operatively coupled to a communications processing unit, which in turn is coupled to a wireless communications unit.

9. The wayside LED signaling device of claim 7, wherein the mechanism connects the LED circuit when the output of the LED array is above a predefined threshold value, and disconnects the LED circuit when the output of the LED array is below the predefined threshold value.

10. The wayside LED signaling device of claim 9, wherein the predefined threshold value is based on a rated light output of the LED array.

11. Method for monitoring a light emitting diode (LED) circuit in a wayside light emitting diode (LED) signaling device comprising:

installing a light emitting diode (LED) circuit comprising a LED array with a plurality of LEDs, a LED driver unit for driving the LED array, and a mechanism for connecting and disconnecting the LED circuit in a wayside LED signaling device, installing an optical light sensing circuit comprising at least one light-controlled variable resistor operably coupled to a resistor driver unit comprising a relay module in the wayside LED signaling device, wherein the at least one light-controlled variable resistor is placed in proximity to the LED array to monitor an output of the LED array, and wherein the relay module is in communication with the mechanism to connect or disconnect the LED circuit based on the output of the LED array, and further comprising operably connecting the LED signaling device to at least one vital processing system of a wayside interface unit configured to monitor and control the LED signaling device, wherein the LED circuit further comprises a passive inductor arranged in series with the LED array, and a passive bandpass filter arranged in parallel with an output of the vital processing system for performing cold filament checks.

12. The method of claim 11, wherein, before installing the LED circuit and the optical light sensing circuit, existing incandescent light bulb circuits are removed from the wayside signaling device.

13. The method of claim 11, wherein the mechanism connects the LED circuit when the output of the LED array is above a predefined threshold value, and disconnects the LED circuit when the output of the LED array is below the predefined threshold value.

14. The method of claim 13, wherein the mechanism connects the LED circuit when the output of the LED array is at least 50% of the rated light output of the LED array.

15. The method of claim 13, wherein the mechanism disconnects the LED circuit when the output of the LED array is less than 50% of the rated light output of the LED array.

* * * * *